United States Patent [19]

Churlaud

[11] 4,368,985

[45] Jan. 18, 1983

[54] MIXER FOR GRANULAR PRODUCTS, IN PARTICULAR FOR FOUNDRY SAND

[75] Inventor: Henri A. Churlaud, Brunoy, France

[73] Assignee: Societe Anonyme des Etablissements Ph. Bonvillain & E. Ronceray, Choisy-le-Roi, France

[21] Appl. No.: 224,670

[22] Filed: Jan. 13, 1981

[30] Foreign Application Priority Data

Jan. 24, 1980 [FR] France ..... 80 01512

[51] Int. Cl.[3] ..... B28C 5/16; B01F 7/16

[52] U.S. Cl. ..... 366/28; 366/52; 366/65; 366/67; 366/137; 366/196

[58] Field of Search ..... 366/26, 27, 28, 29, 366/42, 54, 52, 56, 196, 57, 53, 64, 65, 66, 67, 68, 136, 137, 184, 159, 309

[56] References Cited

U.S. PATENT DOCUMENTS 1,804,629 5/1931 McCabe ..... 366/28

3,635,449 1/1972 Johnson ..... 366/66

4,175,869 11/1979 Churlaud ..... 366/42

*Primary Examiner*—Philip R. Coe

*Assistant Examiner*—Joseph M. Pitko

*Attorney, Agent, or Firm*—Weingarten, Schurgin, Gagnebin & Hayes

[57] ABSTRACT

This mixer comprises a cylindrical tank 5 having a fixed lateral wall 7 and a rotary bottom 9 rotatably mounted inside the lower part of the fixed lateral wall. It is characterized in that the rotary bottom 9 comprises a peripheral collar 18 overhanging its lateral face and forming an annular gap with wall 7, in that an annular projection 21 carried by this latter extends under the collar and defines therewith an annular chamber 22 extending between the lateral face of bottom 9 and wall 7, and in that the chamber communicates with the tank through the annular gap and emerges under the bottom 9 into a narrow annular slit provided between the lateral face of the bottom and the projection 21.

7 Claims, 3 Drawing Figures

MIXER FOR GRANULAR PRODUCTS, IN PARTICULAR FOR FOUNDRY SAND

The present invention relates to a mixer for granular products, in particular for foundry sand, of the type comprising a cylindrical tank having a fixed lateral wall and a rotary bottom rotatably mounted inside the lower part of the fixed lateral wall.

The rotary bottom of mixers of this type has a peripheral seal extending above a fixed annular part projecting from the internal face of the lateral wall of the tank. The seal, which is in permanent contact with the annular part, is subjected to very high friction forces during rotation of the rotary bottom and is thus exposed to particularly intense and rapid wear. To avoid the formation of leaks, it is then desirable to replace it frequently, which has unfortunately the disadvantage of incurring high maintenance costs and of requiring a relatively long downtime of the mixer which cannot then be used to the maximum of its possibilities.

The present invention proposes remedying these disadvantages and, for this, it provides a mixer of the above-mentioned type which is characterized in that the rotary bottom comprises a peripheral collar projecting over its lateral face and forming an annular gap with the lateral wall of the tank, in that an annular projection carried by the lateral wall of the tank extends under the collar and defines therewith an annular chamber extending between the lateral face of the rotary bottom and the lateral wall of the tank, and in that the chamber communicates with the tank through the annular gap and opens under the rotary bottom through a narrow annular slit provided between the lateral face thereof and the projection.

With such an arrangement, the chamber contains permanently a highly compressed quantity of product. The filling thereof, which is carried out under force under the very considerable weight of the load tipped into the tank, is in fact accompanied by very high compression of the product which it contains. Now, because of the compression thereof, this product loses its fluidity and so does not therefore tend to infiltrate into the annular slit, especially since the centrifugal force generated by the rotation of the rotary bottom further opposes its entry into this slit.

Thus it will be readily understood that the present invention allows a very satisfactory seal to be obtained between the rotary bottom and the lateral wall of the tank, by means of a seal formed by the product itself.

The product contained in the chamber, because of its compression, tends moreover to adhere to the collar and to the projection, especially if it is damp. Intense shearing forces are then exerted in the mass thereof during rotation of the rotary bottom and force it to separate into two superimposed layers whose contact surfaces are exposed to friction forces. Now, since these forces are exerted in the mass of the product and not on the collar and the projection, these latter are then perfectly protected against any risk of wear.

The present invention also has the advantage of reducing considerably the maintenance costs of the mixer.

According to a preferred embodiment of the invention, the slit is narrower than the gap. This arrangement allows the seal to be further improved between the rotary bottom and the lateral wall of the tank. In fact, since the product can enter the chamber much more easily than it can leave, it jams therein and is further compressed, which makes it still more compact and so less likely to pass through the annular slit.

This arrangement provides furthermore a better protection of the collar and the projection against risks of wear. By furthering compression of the product contained in the chamber, the product can in fact adhere better to the collar and to the projection which are thus further protected against the action of possible friction forces.

Preferably, the gap and the slit extend coaxially with the lateral wall of the tank.

Since the walls defining the gap and the slit are here cylindrical in form, machining thereof can obviously be achieved easily and at a low cost. It should furthermore be noted that the cylindrical shape of the gap also contributes to increasing the compression of the product in the chamber. The weight of the product tipped into the tank can in fact be exerted directly on the contents of the chamber.

To avoid the product in the gap from causing abnormal wear of the peripheral collar, this latter is advantageously provided on its face turned towards the lateral wall of the tank with inserted studs made from a wear-resistant material and projecting into the gap.

During rotation of the rotary bottom, the inserted studs force their way through the product in the gap. In doing this, they drive this product away from the lateral face of the projection which is then protected against premature wear.

Advantageously, the peripheral collar is formed by removable sectors situated in the extension of the upper face of the rotary bottom.

Because of these sectors, the rotary bottom would not have to be replaced as a whole if the wear of the collar became too great. It would in fact be sufficient to change the worn sectors to recondition the collar, which is easy to achieve and in addition reduces very considerably repair costs.

It will be noted here that the material forming the sectors could be different from that used for forming the rotary bottom. For example, when the studs are fixed by welding to the sectors, these latter could be made from steel whereas the rotary bottom could be made from cast-iron.

Preferably, the sectors are fixed by means of small plates bearing on their upper face as well as on that of the rotary bottom, these plates being held in place by countersunk screws some of which cooperate only with the rotary bottom whereas others cooperate both with the sectors and with the rotary bottom.

The sectors are thus secured simply and reliably.

According to a particularly advantageous arrangement, the upper part of the annular projection is formed by removable annular sectors having a wear-resistant coating along their periphery bordering the inlet of the slit.

The projection is obviously better protected against the wear which might be caused by the material contained in the chamber. Maintenance thereof is furthermore less expensive since it is sufficient to replace the sectors forming its upper part.

According to another feature of the invention, the slit opens above an annular flange projecting under the rotary bottom, this flange which is swept by scraping means carried by the rotary bottom, being itself supported by the lateral wall of the tank and comprising an opening emerging above a hopper provided with means for bringing its contents back to the upper part of the tank.

The product which might flow in the form of a leak through the slit would thus be immediately recycled. It would not then risk being scattered on the ground of the sand-moulding shop which must remain perfectly clear so as not to hinder the employees in their activities.

One embodiment of the present invention will be described hereafter by way of example with reference to the accompanying drawings in which.

Figure 1:
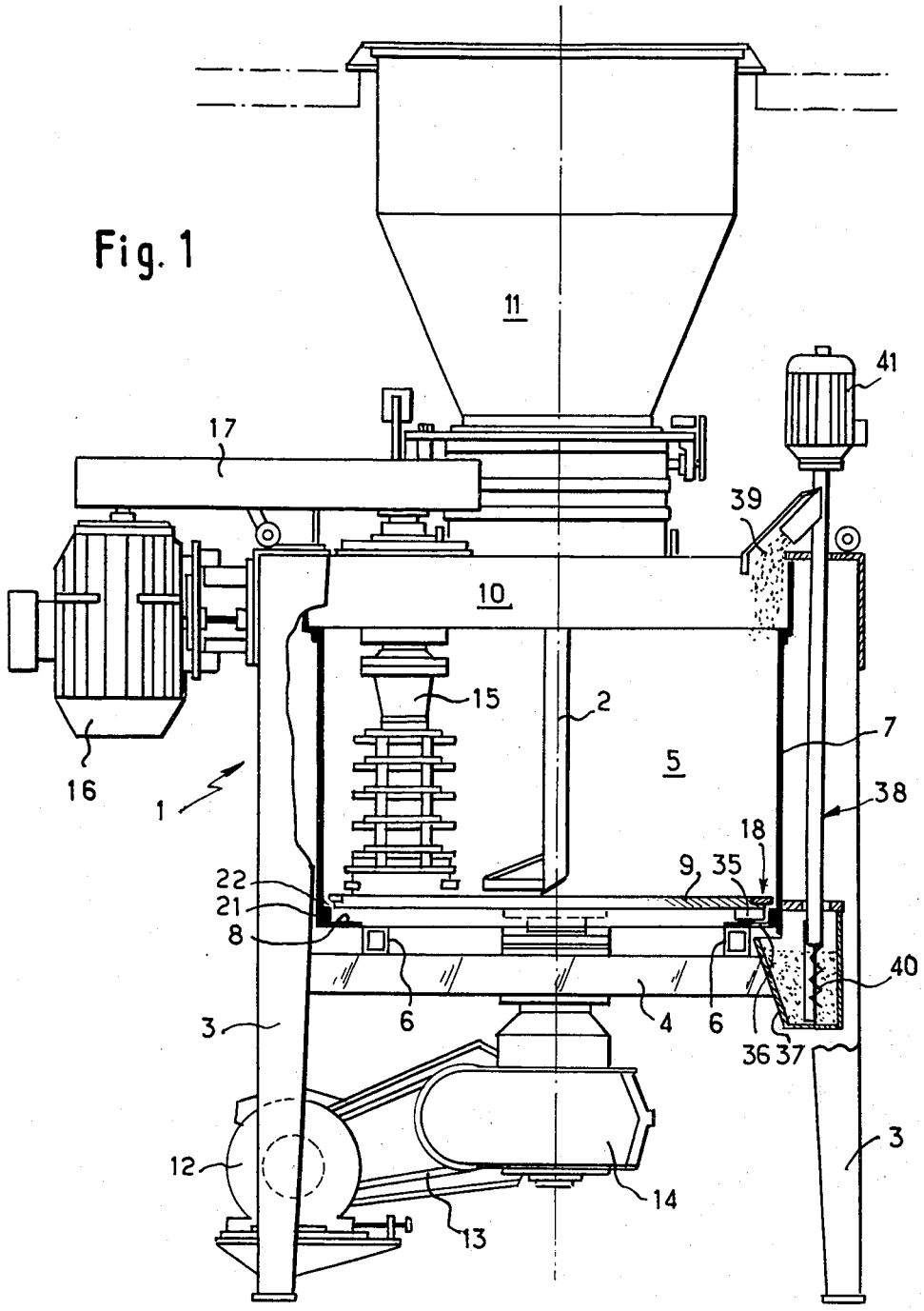
FIG. 1 is a schematical view, partially in section, showing a mixer in accordance with the invention.

The mixer which can be seen in FIG. 1 is more particularly intended for the preparation of foundry sands. It comprises a frame 1 having a vertical axis of symmetry 2, this frame comprising particularly four uprights 3 supporting a horizontal beam 4 the middle of which is centred on axis 2. It comprises further a cylindrical tank 5 resting vertically on frame 1 through means such as those shown at 6 in FIG. 1.

Tank 5, which is intended to receive the sand to be prepared, comprises a fixed lateral wall 7 whose lower part is provided with an annular flange 8 extending radially inwards, and a rotary bottom 9 rotatably mounted above flange 8.

Lateral wall 7 is closed at its upper part by a structure 10 comprising an orifice, not shown, communicating with the outlet of a hopper 11 containing the sand to be prepared. It is further provided with a drain trap, not shown, for discharging the sand when the preparation thereof is finished.

As for rotary bottom 9, it extends coaxially with axis 2 and is rotatably driven by a motor 12 to which it is connected by a transmission 13 and a reducer 14, the output shaft of this latter passing through beam 4 and extending as far as the lower face of the rotary bottom with which it is integral.

A vertical turbine 15 is furthermore provided inside the tank. This turbine, which is adjacent lateral wall 7, is supported by structure 10 and is rotatably driven by a motor 16 to which it is connected by means of a belt 17.

In accordance with the present invention, rotary bottom 9 comprises a peripheral collar 18 overhanging its lateral face 19 and forming an annular gap 20 with lateral wall 7. Furthermore, an annular projection 21 carried by wall 7 extends under collar 18 and defines therewith an annular chamber 22, this chamber communicating permanently with the inside of the tank through gap 20 and emerging under the rotary bottom into a narrow annular slit 23 provided between lateral face 19 and projection 21.

By way of indication, it will be noted that in the embodiment shown in the drawings, gap 20 has a width of 5 mm whereas slit 23 has a width of the order of 2.5 mm. Chamber 22 has a height of about 10 mm and a width of about 70 mm.

During operation of the mixer, chamber 22 is entirely filled with sand, its contents being highly compressed because of the very high weight of the load which is tipped into the tank.

Because of its compression, the sand contained in the chamber loses its fluidity and may then flow through slit 23 only with difficulty, especially since the rotary bottom subjects it to a centrifugal force tending to drive it away from the inlet thereof.

Thus, the risks of leaks appearing between the rotary bottom and the lateral wall of the tank are practically totally eliminated.

Furthermore, since the compressed sand in chamber 22 is slightly damp, it adheres strongly to the lower face of the collar as well as to the upper face of the projection. During rotation of the rotary bottom, it is therefore forced to separate into two superimposed layers and its mass is subjected to intense frictional forces appearing in the contact zone of the two layers. On the contrary, the lower face of the collar and the upper face of the projection are protected against such forces since no relative movement appears between them and the sand, which shields them from any risk of wear.

Figure 2:
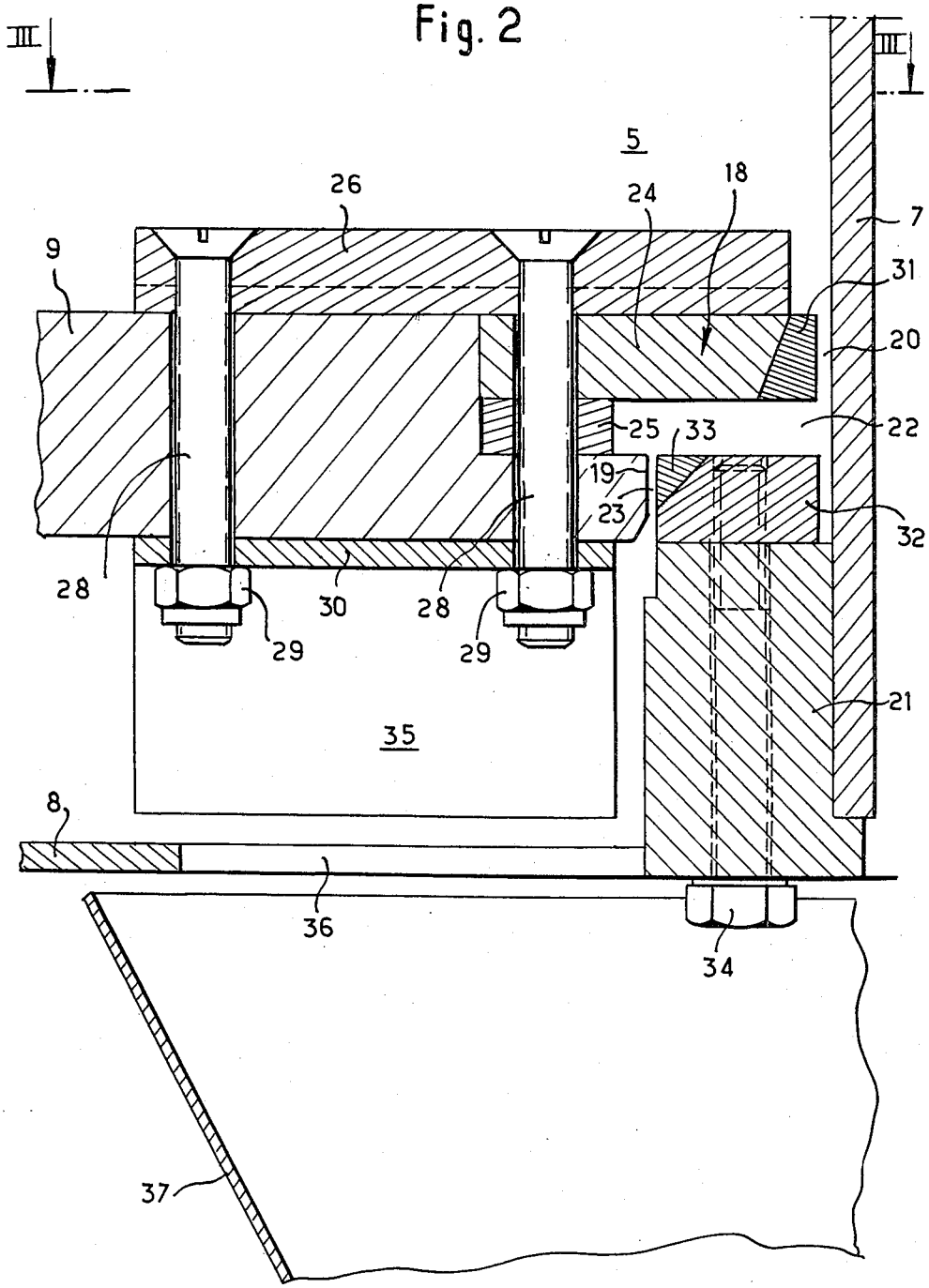
FIG. 2 is a sectional view, on a larger scale, showing the part of the rotary bottom situated on the right of FIG. 1.
Figure 3:
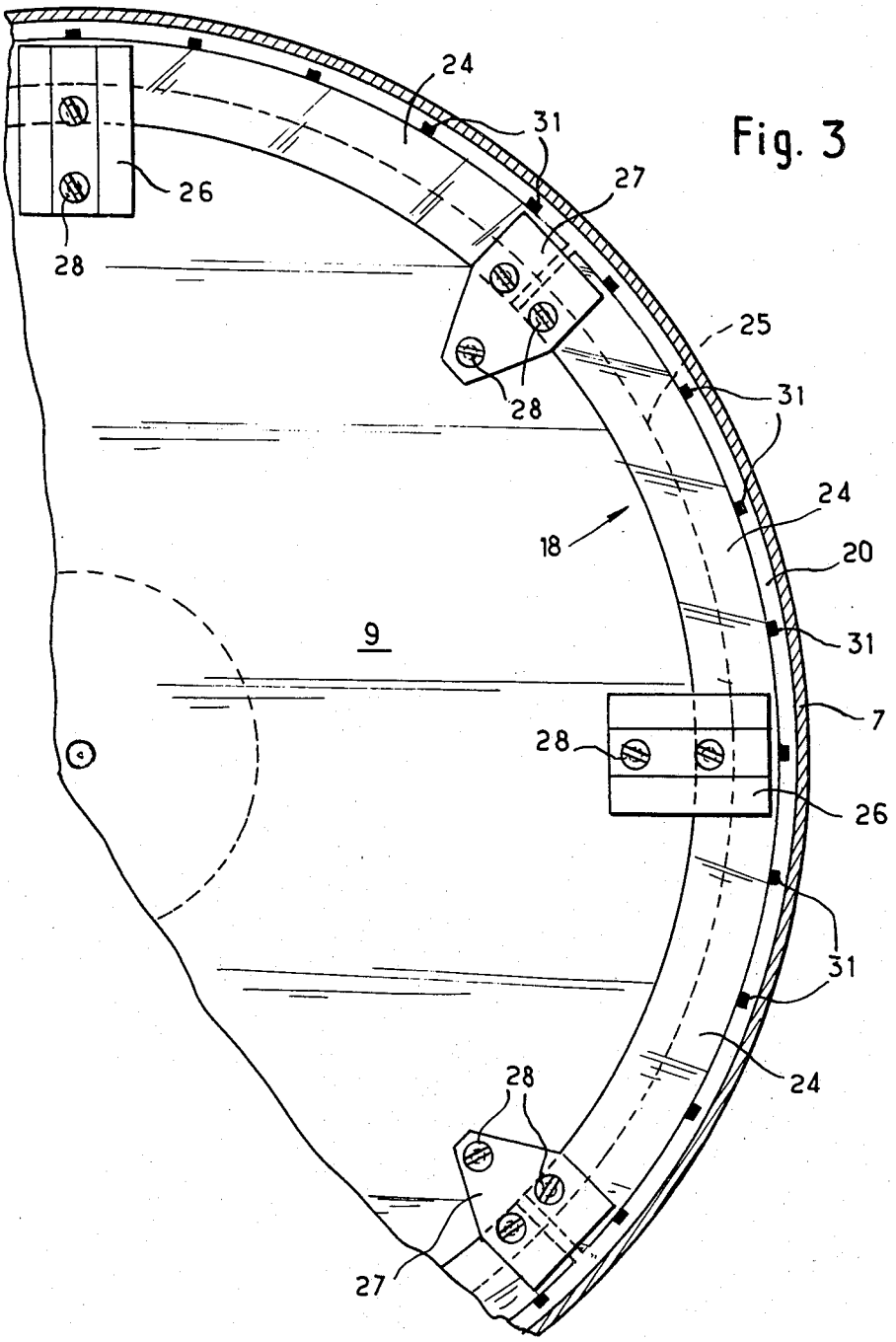
FIG. 3 is a sectional view along line III—III of FIG. 2.

Referring particularly to FIGS. 2 and 3, it will be noticed that collar 18 is formed by removable sectors 24 situated in the extension of the upper face of the rotary bottom. These sectors, which rest on annular chocks 25 (only one of which is visible in FIG. 2) are fixed to the rotary bottom by means of small plates 26 and 27. As can be seen in FIG. 3, plates 26 bear on the middle part of the sectors as well as on the rotary bottom and are held in place by two countersunk screws 28 cooperating one with a tapping formed in the rotary bottom and the other with aligned tappings formed in the sector to be fixed, in the chock supporting this latter and in the rotary bottom. As for plates 27, they bear on the adjacent ends of two sectors as well as on the rotary bottom and are held in place by three countersunk screws 28 cooperating one with a tapping formed in the rotary bottom and the other two with aligned tappings formed in the two adjacent sectors to be fixed, in the corresponding chocks and in the rotary bottom.

To prevent the screws 28 holding the same plate from being accidentally unscrewed, nuts 29 are screwed on their free end and apply against the lower face of the rotary bottom a connecting plate 30 such as can be seen in FIG. 2.

It will be further noticed that sectors 24 are provided on their face turned towards lateral wall 7 with equidistant studs 31 projecting into gap 20, these studs being formed for example from Chpolansky "fillers" which are known for their very great resistance to abrasion.

Thanks to this arrangement, the sectors are protected satisfactorily against intense wear which the sand contained in gap 20 might exert thereon during rotation of the rotary bottom. In describing their circular path, the studs in fact drive the sand away from the sectors which are consequently protected from the abrasive action thereof.

Referring now to FIG. 2, it will be noted that the upper part of annular projection 21 is formed by removable annular sectors 32 provided along their periphery bordering the inlet of slit 23 with a coating 33 made from a resistant material. This coating, which is preferably formed by a Chpolansky "filler", protects of course sectors 32 against the possible abrasive action which the sand contained in chamber 2 might exert thereon if it flowed inopportunely in the form of a leak through slit 23.

It should be noted that sectors 32, which are fixed by screws 34 whose head projects from the lower face of projection 21, may be formed with different thicknesses so as to give to chamber 22 the most appropriate height for obtaining the best seal at slit 23 and so as to reduce to a maximum the risk of wear of the active parts of the mixer.

Referring now to FIG. 1, it can be seen furthermore that rotary bottom 9 carries on its lower face a scraper 35 advancing slightly above flange 8 and that this latter comprises, in the path of the scraper, an aperture 36 opening above a hopper 37 into which plunge transport means 38 whose outlet communicates with a chute 39 opening into the upper part of tank 5. In the example shown means 38 are formed by an endless screw 40 rotatably driven by a motor 41. It will however be evident that they could be formed by a pneumatic installation or any other lifting means.

It may happen that small leaks appear through slit 23. In this case, the sand falling on flange 8 is pushed by the scraper which, at each rotation of the rotary bottom, brings it above opening 36 and allows it to fall into hopper 37. In this latter, it is then transported by endless screw 40 to chute 39 through which it falls back again into the tank to be recycled with the load being treated.

It will then be readily understood that the part of the ground situated under the rotary bottom may thus remain perfectly clean during operation of the mixer.

For the sake of completeness, sand which might leave chamber 22 in the form of a leak would be automatically replaced by sand coming from the tank. The contents of the chamber would then be self-renewed.

The above discussion shows then clearly that the present invention allows an excellent seal to be obtained between the rotary bottom and the lateral wall of the tank of the mixer and the wear of the active parts thereof to be greatly reduced, the mixer then being able to operate for a long time without maintenance.

What is claimed is:

1. A mixer for granular products, in particular for foundry sand, of the type comprising a cylindrical tank having a fixed lateral wall and a rotary bottom rotatably mounted inside the lower part of the fixed lateral wall, characterized in that the rotary bottom (9) comprises a peripheral collar (18) overhanging a lateral face (19) on an outer edge of said bottom and forming an annular gap (20) with the lateral wall (7) of the tank (5), in that an annular projection (21) carried by the lateral wall of the tank extends under the collar (18) and defines therewith an annular chamber (22) extending between the lateral face (19) and the lateral wall (7), and in that the chamber (22) communicates with the tank (5) through the annular gap (20) and emerges under the rotary bottom (9) into an annular slit (23) provided between the lateral face (19) and the projection (21), this slit being narrower than the gap (20).

2. The mixer as claimed in claim 1, characterized in that the gap (20) and the slit (23) extend coaxially with the lateral wall (7) of the tank (5).

3. The mixer as claimed in claim 1 or 2, characterized in that the peripheral collar (18) is provided on a face thereof confronting the lateral wall (7) of the tank (5), with inserted studs (31) formed from a wear-resistant material and projecting into the gap (20).

4. The mixer as claimed in claims 1 or 2, characterized in that the peripheral collar (18) is formed by removable sectors (24) situated in the extension of the upper face of the rotary bottom.

5. The mixer as claimed in claim 4, characterized in that the sectors (24) are fixed by means of small plates (26, 27) bearing on their upper face as well as on that of the rotary bottom (9), these plates being held in place by countersunk screws (28) some of which cooperate only with the rotary bottom (9) whereas others cooperate both with the sectors (24) and the rotary bottom (9).

6. The mixer as claimed in claims 1 or 2, characterized in that the upper part of the annular projection (21) is formed by removable annular sectors (32) provided with a wear-resistant coating (33) along their periphery bordering the inlet of the slit (23).

7. The mixer as claimed in claims 1 or 2, characterized in that the slit (23) opens above an annular flange (8) extending under the rotary bottom, this flange, which is swept by scraper means (35) carried by the rotary bottom (9), being itself carried by the lateral wall (7) of the tank (5) and comprising an aperture (36) opening above a hopper (37) provided with means (38) for bringing its contents back to the upper part of the tank.

* * * * *